United States Patent [19]

Hatakeyama et al.

[11] Patent Number: 4,489,944

[45] Date of Patent: Dec. 25, 1984

[54] MANIPULATIVE EGG-SHAPED PUZZLE

[75] Inventors: Morichika Hatakeyama; Koichi Minami, both of Tokyo, Japan

[73] Assignee: Tomy Kogyo Co., Inc., Tokyo, Japan

[21] Appl. No.: 530,711

[22] Filed: Sep. 9, 1983

[51] Int. Cl.[3] ..... A63F 9/08

[52] U.S. Cl. ..... 273/154

[58] Field of Search ..... 273/153 R, 154

[56] References Cited

U.S. PATENT DOCUMENTS

| | | | |
|---|---|---|---|
| 479,158 | 7/1892 | Smallwood | 273/154 |
| 1,235,306 | 7/1917 | Fredrick | 273/154 |
| 3,759,420 | 9/1973 | Karkanen | 273/153 R X |

*Primary Examiner*—Anton O. Oechsle

*Attorney, Agent, or Firm*—Staas & Halsey

[57] ABSTRACT

An amusement device consisting of a manipulative egg-shaped puzzle having top and bottom housings rotatably connected by an internal mechanism. The top housing has a movable slide and a transparent window therein. The internal mechanism comprises a color marking thereon; a shaft fixedly connected to the bottom housing and extending from the bottom housing to the top housing; and a biased lever extending into the shaft for normally holding a movable weight at the top thereof, and an internal housing for supporting a plurality of rotation rings, each of which has a color marking thereon and a lever receptacle therein. When the bottom housing is rotated relative to the top housing the plurality of color markings may be aligned at the transparent window. Properly aligning the color markings necessarily aligns the rings and lever receptacles to allow the lever to move into the lever receptacles and out of the shaft. The weight is accordingly released and falls into the bottom housing, thus shifting the center of gravity from the top housing to the bottom housing and allowing the egg to stand upright on the curved bottom housing on a flat surface.

7 Claims, 4 Drawing Figures

MANIPULATIVE EGG-SHAPED PUZZLE

BACKGROUND OF THE INVENTION

This invention relates to an amusement device, and more particularly, to a manipulative egg-shaped puzzle capable of being stood upright on its rounded base.

Manipulative puzzles have recently been very popular amusement devices with people of all ages, especially children. To be popular, the design of these amusement devices must capture the interest of the player, must challenge the player's intellectual curiosity and maintain that curiosity for a reasonable amount of time, must be entertaining for various age groups, and must be durable and relatively simple in design to be long-lasting and safe.

SUMMARY OF THE INVENTION

Accordingly, it is a primary object of this invention to provide a manipulative puzzle which requires concentration, imagination and planning, and thus is entertaining for people of all ages.

It is another object of this invention is to provide a manipulative puzzle which is made of durable plastic and is relatively simple in design and construction to ensure long-lasting and safe play, especially for children.

It is another object of this invention to provide a manipulative puzzle having a weighted internal mechanism which may be manipulated in an almost infinite number of ways, thereby capturing and maintaining the interest and intellectual curiosity of the player.

Finally, it is an object of this invention to provide an egg-shaped puzzle which, although it normally cannot be stood upright, through manipulation of the weighted internal mechanism, is allowed to stand upright, thus completing the puzzle and rewarding the player.

Additional objects and advantages of the invention will be set forth in part in the description which follows, and in part will be obvious from the description, or may be learned by practice of the invention. The objects and advantages of the invention may be realized and obtained by means of the instrumentalities and combination particularly pointed out in the appended claims.

To achieve the foregoing objects and in accordance with the purpose of the invention, as embodied and broadly described herein the amusement device comprises an egg-shaped puzzle capable of a changing center of gravity. More particularly, the present invention has top and bottom housings rotatably connected by an internal mechanism. The top housing has a color marking, a movable slide and a transparent window thereon. The internal mechanism comprises a shaft for receiving a movable weight, an internal housing for supporting a plurality of rotation rings, each of which has a color marking and a lever receptable thereon, and a biased lever connected to the internal housing and extending into the shaft for normally holding the movable weight. When the bottom housing is rotated relative to the top housing the plurality of color markings may be aligned at the transparent window. Properly aligning the color markings necessarily aligns the rings to allow the lever to move into the lever receptacles and out of the shaft. The weight then falls into the bottom housing, thus shifting the center of gravity from the top housing to the bottom housing and allowing the egg to stand upright on the curved bottom housing.

BRIEF DESCRIPTION OF THE DRAWINGS

The accompanying drawings, which are incorporated in and constitute a part of this specification, illustrate the invention and, together with the description, serve to explain the principles of the invention.

DETAILED DESCRIPTION OF THE PREFERRED EMBODIMENT

Reference will now be made in detail to the present preferred embodiment of the invention, an example of which is illustrated in the accompanying drawings.

For convenience of description in the explanation to follow, "external" indicates the outside of the egg, "internal", of course, indicates the inside of the egg, "bottom" indicates the semi-spherically shaped end of the egg, and "top" indicates the parabolically shaped end of the egg.

In accordance with the invention, the amusement device generally comprises an egg-shaped housing wherein a weight, normally held near the top of the egg, is caused to move to the bottom of the egg, thus changing the center of gravity of the egg and allowing the egg to stand upright on its bottom.

Figure 1:
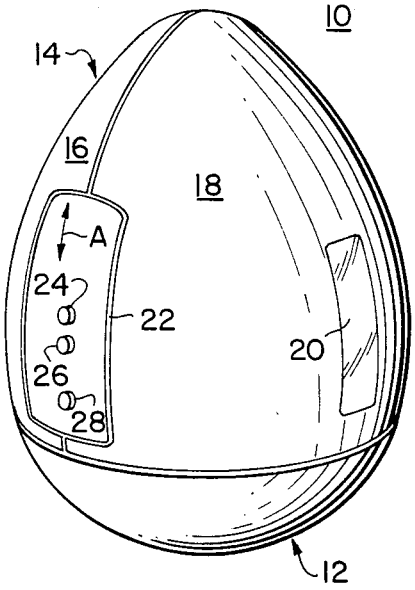
FIG. 1 is a perspective view of a preferred embodiment of the egg puzzle of the present invention, illustrating particularly the movable slide and the transparent window.
Figure 2:
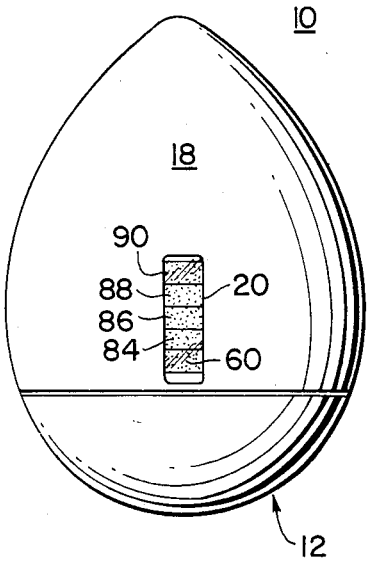
FIG. 2 is a right side view of the manipulative puzzle shown in FIG. 1, illustrating particularly the plurality of color markings visible through the transparent window.

As embodied and shown in FIGS. 1 and 2, the reference numeral 10 designates the manipulative egg-shaped puzzle of the present invention, preferably made of plastic. The egg-shaped puzzle 10 comprises a bottom housing 12 and a top housing 14. The top housing 14 is made up of a left external housing 16 and a right external housing 18. In addition, the egg puzzle 10 comprises a transparent window 20 and a movable slide 22.

Figure 3:
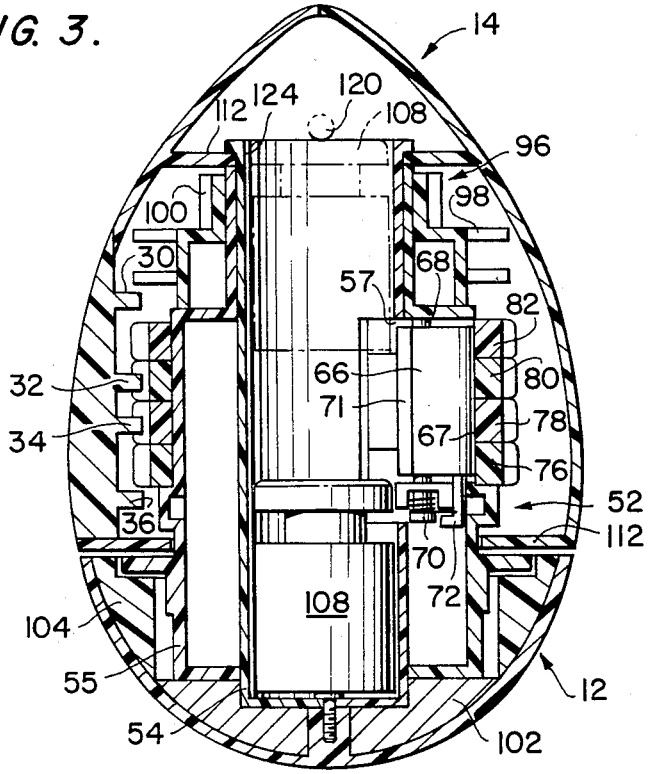
FIG. 3 is a cross-sectional view of the present invention, illustrating particularly the internal mechanism which, through proper manipulation of the device, allows a weight to drop from the top of the egg to the bottom.
Figure 4:
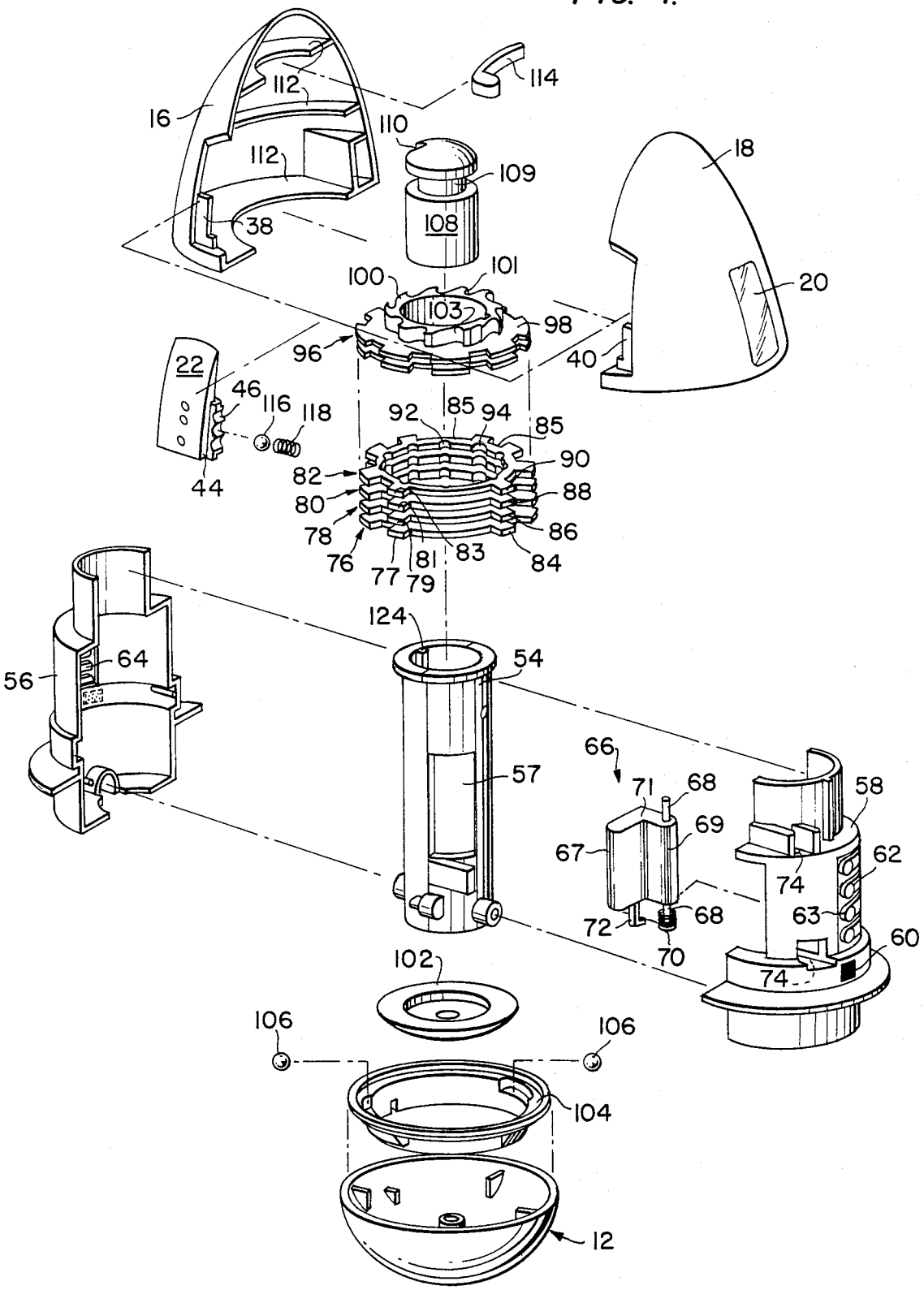
FIG. 4 is an exploded view of the present invention, illustrating particularly the internal mechanism of the present invention.

As best seen in FIGS. 3 and 4, the slide 22 comprises externally first, second, and third slide position indicators 24, 26 and 28, respectively. These projecting indicators 24, 26 and 28 also aid the puzzle player in sliding the slide 22. Internally, the slide 22 comprises first, second, third, and fourth slide projections 30, 32, 34 and 36, respectively. A left slide guide 38 is formed on the left external housing 16, and a right slide guide 40 is formed on the right external housing 18. There is formed laterally on the slide 22 a left slide channel 42 (not shown) and a right slide channel 44 for receiving in sliding relation the left slide guide 38 and the right slide guide 40, respectively. Finally in relation to the slide 22, there is located thereon a three-position ball bearing abutment 46 for receiving a ball bearing located in the upper housing 14, to be discussed more fully hereafter.

Inside the egg-shaped puzzle 10 there is located an internal mechanism 52 comprising a central hollow shaft 54 extending substantially from the bottom of the egg-shaped puzzle 10 to the top. The shaft 54 is surrounded by an internal housing 55 comprising a first half internal housing 56 and a second half internal 58. Located near the base of the second half internal housing 58 is a first color marking 60, the purpose of which will be described hereafter. Also located on the second half internal housing 58 is a plurality of flexible flanges 62, each having a rounded projection 63 on the end thereof. A similar plurality of flexible flanges 64, each having a rounded projection 65 (not shown) on the end thereof, is positioned on the first half internal housing 56.

A lever 66 having a first end 67, a second end 69 and a middle 71 therebetween is connected to the second half internal housing 58. More particularly, the lever 66 has top and bottom lever pins 68 on its second end 69 which are inserted into lever pin receptacles 74 within the second half internal housing 58. The lever 66 is normally biased into an opening 57 in the shaft 54 by a lever spring 70 connected between the right internal housing 58 and a spring holding flange 72.

Surrounding part of the first half internal housing 56 and the second half internal housing 58 are first, second, third and fourth rotation rings, 76, 78, 80 and 82, respectively. The first rotation ring 76 has eight projections 77 in spaced relation radiating therefrom; the second rotation ring 78 has eight projections 79 in spaced relation radiating therefrom; the third rotation ring 80 has eight projections 81 in spaced relation radiating therefrom; and finally, the fourth rotation ring 82 has eight projections 83 in spaced relation radiating therefrom. On each ring 76, 78, 80 and 82 there exists spaces between each projection 77, 79, 81 and 83 denominated by the reference numeral 85 which receive the projections 30, 32, 34 and 36 of the slide 22 to selectively prohibit movement of the rings 76, 78, 80 and 82.

Located on one of the projections on each ring 76, 78, 80 and 82 is a color marking. More particularly, a second color marking, 84; a third color marking, 86; a fourth color marking, 88; and finally a fifth color marking, 90; are located respectively on one of each of the projections 77, 79, 81 and 83.

On the insides of the various rotation rings, 76, 78, 80, and 82, there are located small recesses 92 which temporarily receive projections 63 and 65 as the internal housing 55 rotates relative to the rings 76, 78, 80 and 82. Of course, as the internal housing 55 rotates, clicking noises are heard as the projections 63 and 65 enter the recesses 92.

A single layer recess, i.e., a lever receptacle 94, is also positioned on the inside of each of the rotation rings 76, 78, 80 and 82. Each lever receptacle 94 is positioned at the same location on each ring 76, 78, 80 and 82 relative to the location of the color marking, 84, 86, 88 and 90.

Above the various rotation rings, 76, 78, 80 and 82, and at the top of the central shaft 54 there is located a stationary wheel 96 having ten pair of projections 98 radiating from the side thereof, ten teeth 100 radiating from the top thereof, and troughs 101 between adjacent teeth 100.

Positioned near the bottom of the shaft 54 within the bottom housing 12 is a stationary, relatively dome-shaped weight 102 and a ball bearing receptacle 104 for receiving a pair of ball bearings 106. The ball bearings 106 allow the bottom housing 12 to rotate freely in relation to the top housing 14.

A movable, cylindrically shaped weight 108 normally rests at the top of the central shaft 54. More particularly, the bottom of the movable weight 108 normally rests upon the top surface of the middle 71 of the lever 66 which is normally biased toward the inside of the shaft 54 by spring 70. The movable weight 108 has a first recess 109 formed around the top, and a second large recess 110 formed perpendicular thereto. The recess 109 receives a shaft 120 extending from the top housing 14 for preventing the weight from excessive movement in the top housing 14 during manipulation of the puzzle. The recess 110 allows the weight to "clear" the shaft 120 when the color markings 60, 84, 86, 88 and 90 are aligned to cause the weight 108 to drop. The movable weight 108 also has a third recess 122 (not shown) along its side for receiving a projection 124 formed along the internal side of the shaft 54.

The left external housing 16 and the right external housing 18 each have various support walls 112 for receiving the internal mechanism 52 for rotation therein. A contact arm 114 is connected to the left external housing 16 and normally contacts the teeth 100 of the wheel 96. The right external housing 18 has positioned therein a ball bearing 116 biased by a spring 118 positioned within a receptacle 119 (not shown) formed in the right external housing 18. The ball bearing 116 is biased against the three position ball bearing abutment 46 of the slide 22.

Finally, as is well known in the art, several of the various members making up this puzzle may be held together by screws, or the like (not shown). Thus, the first and second halves 56 and 58, respectively, of the internal mechanism 55 are secured together. The stationary weight 102 is positioned between the bottom housing 12 and the internal housing 55, which are fixedly connected together. However, the rings 76, 78, 80 and 82 are allowed to rotate about the internal housing 55 depending upon the position of the slide projections 30, 32, 34 and 36. The wheel 96 remains stationary on the internal housing 55. Of course, the weight 108 may move depending upon the position of the lever 66. The contact arm 114 is secured to the left external housing 16. The left external housing 16 and the right external housing 18 are fixedly connected to each other and extend around the internal mechanism 52, with the slide 22 being allowed to move therebetween.

The operation of the above-described egg-shaped puzzle 10 will now be explained.

First of all, the puzzle player should attempt to stand the egg upright on its base. Invariably the egg falls to its side unless the internal mechanism is properly aligned, as will be discussed. Proper manipulation requires coordinated movements of the slide 22 and rotation of the bottom housing 12. The player will have solved the puzzle when the egg stands upright, on its bottom, on a flat surface without tipping over.

The slide 22 is capable of taking three different positions, "Down" (all the way down), "Middle" (middle), or "Up" (all the way up), by moving the slide 22 in the directions indicated by arrow "A" in FIG. 1. The three position slide 22 controls which of the rings 76, 78, 80 and 82 move along with the internal housing 55 and which stay in position when the bottom housing 12 is turned. With each position taken by the slide 22, the projections 30, 32, 34 and 36 inhibit rotation of a different combination of rings 76, 78, 80 and 82 relative to the top housing 14.

The following chart correlates the position of the slide 22 with the rings 76, 78, 80 and 82 which will move with the internal housing 55 when the slide 22 is in a particular position.

| When the Bottom Housing 12 is Turned Clockwise and the Slide is in Position: | The Ring(s) That Is/Are Moving With the Internal Housing 55 are: | And the Following Rings Remain Stationary |
|---|---|---|
| Up | 76, 82 | 78, 80 |
| Middle | 78 | 76, 80, 82 |
| Down | 76, 80 | 78, 82 |

The rings 76, 78, 80 and 82, and the internal housing 55 are synchronized to move one position with each clockwise turn of the bottom housing 12. This is directly related to the fact that the contact arm 114 passes each tooth 100 in sequence as the bottom housing 12 is turned. More particularly, counterclockwise direction is impossible because when the contact arm 114 is received by the troughs 101 between teeth 100, the wheel 96 stops, whereas in the clockwise direction, contact arm 114 merely slides along the gradually inclined sides 103 of the teeth 100.

To actually manipulate this puzzle, the egg puzzle 10 is held vertically about the top housing 14 by one hand with the bottom housing 12 being held by the other hand and extending downwardly. With the window 20 facing the puzzle player, the slide 22 is pushed the farthest upward, i.e., position "Up". With the fingers of the other hand, the bottom housing 12, which is rotatably mounted on the upper housing 14 through the internal mechanism 52, is turned in the clockwise direction. While turning the lower housing 12 of the puzzle 10, the player may confirm through the transparent window 20 that some of the rings 76, 78, 80 and 82 and the internal housing 55 are turning inside the egg-shaped puzzle 10, while other of the rings 76, 78, 80 and 82 remain stationary, as described above. The slide 22 is now pushed as far to the bottom as possible, i.e., position "Down" and again the lower housing 12 of the egg puzzle 10 is turned in a clockwise direction. It is noted that a different combination of rings 76, 78, 80 and 82 and the internal housing 55 moves than was observed in the above-described rotation of the lower housing 12. Similarly, if the slide 22 is moved to the middle position, i.e., position "Middle" a different combination is seen.

The reason for the above-discussed different combinations is as follows. As stated above, there are eight projections 77, 79, 81 or 83 on each of the four rings 76, 78, 80 and 82, repectively. Only one of each of the projections 77, 79, 81, 83 on each of the rings 76, 78, 80 and 82 has a color markings 84, 86, 88 and 90 thereon. In addition, a color marking 60 is located on the second half internal housing 58. When the five color markings 60, 84, 86, 88 and 90, are lined up at the window 20, the lever receptacles 94 are also necessarily lined up, at which point the first end 67 of the lever 66 is allowed to move into the colinear recess formed by the lined up lever receptacles 94. As the first end 67 of the lever 66 enters the colinear recess formed by the lever receptacles 94, the middle 69 of the lever 66 necessarily moves out of the interior of the shaft 54 and no longer supports the movable weight 108 in the top of the egg-shaped puzzle 10. Since the weight 108 is no longer supported, when the egg is returned to an upright position, the weight 108 is free to fall down the shaft into the bottom housing 12. The falling weight 108 is shown in phantom lines in FIG. 3. The center of gravity of the puzzle is effected greatly by the weight 108 dropping to the bottom, so much so that the egg-shaped puzzle 10 may be stood upright on its curved bottom on a flat surface.

The object of the puzzle then is to line up all five of the color markings 60, 84, 86, 88 and 90 at the transparent window 20. By turning the bottom housing 12, periodically moving the slide 22 and visualizing where the color markings 60, 84, 86, 88 and 90 are in relation to each other, the manipulator can solve the puzzle and stand the egg on its bottom housing 12 without it tipping over.

Once the manipulator has solved the puzzle, the egg puzzle can be reset by turning the egg upside down, upon which the weight 108 shifts again to the top housing 14. The slide 22 is then moved to the "Down" position, and the bottom housing 12 is turned several times to "scramble" the egg.

In view of the foregoing written description of the preferred embodiment and accompanying drawings, it is seen that the egg puzzle can be manipulated in such a way that many different configurations of the puzzle may be seen. It is further seen that the manipulative puzzle of the present invention is relatively simple in construction and can be formed of plastic for durability and safety, for especially the children playing with the device. In addition, the almost infinite number of configurations the puzzle is capable of taking, piques the player's curiosity. It will be apparent, however, to those skilled in the art that modifications and variations could be made in the manipulative puzzle in accordance with the teachings of the invention without departing from the spirit or scope of the invention. Thus, it is intended that the present invention cover the modifications and variations of this invention within the scope of the appended claims and their equivalents.

What is claimed is:

1. An amusement device, comprising:

(a) a first housing defining an area;

(b) a curved second housing defining an area and being rotatably connected to the first housing;

(c) a first movable means having a plurlity of rotatable members located within the areas defined by the first and second housings for rotatably connecting the first and second housings, the first means having a weight normally positioned in the area defined by the first housing and being movable along a substantially straight line into the area defined by the second housing, and (d) a second movable means operatively connected to the first movable means for allowing selective rotation of each of the plurality of rotating members, wherein, when the second housing is rotated relative to the first housing, at least one of the plurality or rotatable members of the first movable means rotates and the weight is caused to move into the area of the second housing.

2. The amusement device as recited in claim 1, wherein the first movable means further comprises:

(i) a hollow shaft extending between the second housing and the first housing for receiving the weight;

(ii) a third housing surrounding and fixedly connected to the hollow shaft; and (iii) a third movable means connected to the third housing and extending into the shaft for holding and releasing the weight, wherein when the third movable means moves, the weight is removed from holding relation with the second movable means and is released to move from the area of the first housing to the area of the second housing.

3. The amusement device as recited in claim 2, wherein each of the plurality of rotatable members is a rotation ring rotatably located on the third housing, each rotation ring having a recess therein for receiving the third movable means, wherein, when each of the recesses is colinear, the third movable means enters the colinear recesses and is removed from holding relation with the weight.

4. The amusement device as recited in claim 3, wherein the the second means is a movable slide located on the first housing and having projections thereon extending into the area defined by the first housing for selectively prohibiting rotation of one or more of the plurality of rotation rings.

5. The amusement device as recited in claim 4, wherein each of the plurality of rotation rings and the third housing has a color marking located thereon, and wherein the first housing further comprises a transparent window for viewing the color markings.

6. The amusement device as recited in claim 5, wherein, when all of the color markings are visible through the transparent window the recesses for receiving the second movable means are colinear.

7. An amusement device comprising:

(a) a first housing having a transparent window and a movable slide with projections thereon extending internally of the first housing;

(b) a second housing having a curved surface and being rotatably connected to the first housing;

(c) an internal mechanism for rotatably connecting the first and second housings, the internal mechanism having:

(i) a movable weight;

(ii) a central hollow shaft extending between the second housing and the first housing for receiving the movable weight;

(iii) a third housing having a color marking thereon and surrounding and being fixedly connected to the shaft;

(iv) a movable means connected to the third housing and extending into the shaft for normally holding the weight in the first housing and releasing the weight; and (v) a plurality of rotation rings surrounding the third housing, each rotation ring having a color marking thereon and a movable means receptacle therein, wherein movement of the movable slide selectively prohibits rotation of one or more of the rings, and wherein alignment of all of the color markings at the transparent window causes the movable means receptacles to line up and to receive the movable means, thus removing the movable means from holding relation with the weight, allowing the weight to move through the shaft, changing the center of gravity of the amusement device and allowing the device to stand upright on the curved second housing.

* * * * *